US009617041B1

(12) United States Patent
DeLaVergne et al.

(10) Patent No.: US 9,617,041 B1
(45) **Date of Patent: *Apr. 11, 2017**

(54) CONVERSION ENVELOPES

(71) Applicant: ecoEnvelopes, LLC., Stillwater, MN (US)

(72) Inventors: Carol A. DeLaVergne, Stillwater, MN (US); Gale G. Ward, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/533,087

(22) Filed: Nov. 4, 2014

Related U.S. Application Data

(63) Continuation-in-part of application No. 12/708,551, filed on Feb. 19, 2010, now Pat. No. 8,875,985.

(60) Provisional application No. 61/208,011, filed on Feb. 19, 2009.

(51) Int. Cl.
*B65D 27/06* (2006.01)

(52) U.S. Cl.
CPC ..... *B65D 27/06* (2013.01)

(58) Field of Classification Search
CPC ..... B65D 27/06; B65D 27/14; B65D 27/34; B42D 15/08; Y02W 30/807
USPC ..... 229/301–316
See application file for complete search history.

(56) References Cited

U.S. PATENT DOCUMENTS 1,438,122 A * 12/1922 McCoy ..... B65D 27/04 229/303
1,953,192 A * 4/1934 Rossiter ..... B65D 27/04 229/302
1,957,704 A * 5/1934 Drachman ..... B65D 27/06 229/305
1,960,054 A * 5/1934 Johnson ..... B42D 15/08 229/303
1,988,908 A * 1/1935 MacKinnon ..... B65D 27/04 229/71
2,007,624 A * 7/1935 Von Ardenne ..... H03F 1/08 330/200
2,129,705 A * 9/1938 Reineman ..... B65D 27/06 229/301
2,201,538 A * 5/1940 Holden ..... B42D 15/08 229/306
2,310,371 A * 2/1943 Lines ..... B65D 27/34 206/455
2,340,700 A * 2/1944 Sawdon ..... B42D 15/08 229/303
2,350,100 A * 5/1944 Deutschmeister ..... B42D 15/08 229/303
2,363,957 A * 11/1944 Goff ..... B65D 27/14 229/313
2,400,406 A * 5/1946 Godoy ..... B65D 27/16 206/264
2,417,982 A * 3/1947 Histed ..... B42D 5/028 229/92.3

(Continued)

*Primary Examiner* — Peter Helvey
(74) *Attorney, Agent, or Firm* — Albert W. Watkins

(57) ABSTRACT

The present invention provides an envelope that converts from a larger envelope to a smaller envelope to enable the envelope to be reused when multiple page statements are mailed or when barcodes would otherwise prevent the reuse. A larger envelope can convert down to a smaller reply envelope, making the return envelope suitable for automated remittance processing. As such, envelopes may advantageously be provided that can be reused one or more times.

6 Claims, 15 Drawing Sheets

(56) References Cited

U.S. PATENT DOCUMENTS 2,835,512 A * 5/1958 Whitman ..... B42D 25/29 229/74
2,928,583 A * 3/1960 Law ..... B42D 15/08 229/305
2,941,711 A * 6/1960 Biek ..... B65D 27/04 229/303
2,954,154 A * 9/1960 Mooney ..... B42D 15/08 229/70
3,011,691 A * 12/1961 McGlynn ..... B65D 27/38 229/309
3,062,431 A * 11/1962 Rabenold ..... B65D 27/06 229/303
3,073,509 A * 1/1963 Schuessler ..... B65D 27/04 229/301
3,086,695 A * 4/1963 Lillibridge ..... B65D 27/04 229/303
3,111,257 A * 11/1963 Peach ..... B65D 27/04 229/302
3,111,336 A * 11/1963 Schumacher ..... B42D 15/08 229/305
3,113,716 A * 12/1963 Howard ..... B42D 15/08 229/304
3,152,751 A * 10/1964 Hiersteiner ..... B65D 27/04 229/303
3,167,243 A * 1/1965 Wiley ..... B65D 27/06 229/301
3,184,150 A * 5/1965 Hubbard ..... B42D 15/08 229/305
3,227,360 A * 1/1966 Krueger ..... B65D 27/04 229/303
3,259,304 A * 7/1966 Tichnor ..... B42D 5/025 229/92.8
3,261,623 A * 7/1966 Kiedrowski ..... B42D 15/08 229/305
3,276,669 A * 10/1966 Vilutis ..... B65D 75/68 383/204
3,278,015 A * 10/1966 Bernstein ..... B65D 27/00 206/232
3,330,581 A * 7/1967 Ivarsson-Wallerstrom B41L 1/22 281/5
3,374,940 A * 3/1968 Allison ..... B42D 15/08 229/70
3,380,648 A * 4/1968 De Lyra ..... B65D 27/06 229/300
3,411,699 A * 11/1968 Pine ..... B42D 5/025 229/303
3,426,961 A * 2/1969 Allison ..... B42D 15/08 229/70
3,427,444 A * 2/1969 Tang ..... H03M 13/15 341/94
3,498,528 A * 3/1970 Klein ..... B65D 27/06 229/302
3,507,444 A * 4/1970 Werby ..... B65D 27/00 229/70
3,525,469 A * 8/1970 Sawdon ..... B42D 15/08 229/305
3,531,046 A * 9/1970 Carrigan ..... B65D 27/06 229/314
3,537,637 A * 11/1970 Hiersteiner ..... B65D 27/00 229/300
3,545,669 A * 12/1970 Kinkade ..... B65D 27/06 229/300
3,652,007 A * 3/1972 MacDougall ..... B42D 15/08 229/304
3,653,585 A * 4/1972 Kazaros ..... B65D 27/38 229/309
3,693,869 A * 9/1972 Eaves, Jr. ..... B65D 27/06 229/302
3,718,277 A * 2/1973 Volkert ..... B65D 27/06 229/301
3,747,837 A * 7/1973 Wilson ..... B65D 27/06 229/303
3,802,618 A * 4/1974 Wiessner ..... B65D 27/06 229/304
3,822,492 A * 7/1974 Crawley ..... G09F 3/0288 229/300
3,874,582 A * 4/1975 Wang ..... B65D 27/06 206/232
3,899,127 A * 8/1975 Melander ..... B65D 27/06 229/301
3,910,410 A * 10/1975 Shaw ..... B65D 75/26 206/306
3,941,309 A * 3/1976 Gendron ..... B42C 3/00 229/301
3,946,938 A * 3/1976 Kranz ..... B42D 15/08 229/305
3,979,051 A * 9/1976 Close ..... B65D 27/08 150/145
3,982,689 A * 9/1976 Retrum ..... B65D 27/04 229/313
4,072,264 A * 2/1978 Kranz ..... B65D 27/08 229/72
4,084,694 A * 4/1978 Lainez ..... G11B 23/0328 206/308.1
4,157,759 A * 6/1979 Dicker ..... B65D 27/34 229/301
4,159,129 A * 6/1979 Lockhart ..... G09F 3/0288 283/66.1
4,180,168 A * 12/1979 Hiersteiner ..... B65D 27/06 229/302
4,190,161 A * 2/1980 Gendron ..... B65D 27/04 229/313
4,190,162 A * 2/1980 Buescher ..... B65D 27/06 229/305
4,191,162 A * 3/1980 Simms ..... F24B 1/18 126/529
4,194,631 A * 3/1980 Rangan ..... B65D 27/06 206/804
4,245,775 A * 1/1981 Conn ..... B65D 27/06 229/303
4,288,028 A * 9/1981 Diaz ..... B65D 27/06 229/302
4,308,987 A * 1/1982 Solomon ..... B65D 27/06 206/804
4,332,346 A * 6/1982 Kronman ..... B65D 27/06 229/302
4,334,618 A * 6/1982 Buescher ..... B65D 27/06 229/305
4,354,631 A * 10/1982 Stevenson ..... B65D 27/04 229/303
4,379,573 A * 4/1983 Lomeli ..... B42C 3/00 283/81
4,382,539 A * 5/1983 Kronman ..... B65D 27/04 206/804
4,384,670 A * 5/1983 Dicker ..... B65D 27/06 229/305
4,403,696 A * 9/1983 Newell ..... B65D 27/06 229/314
4,436,202 A * 3/1984 Berkley ..... B65D 27/06 206/455
4,445,635 A * 5/1984 Barr ..... B65D 27/06 229/302
4,487,360 A * 12/1984 Fisher ..... B65D 27/06 229/304
4,538,833 A * 9/1985 Trikilis ..... B42D 7/00 281/15.1
4,549,658 A * 10/1985 Sfikas ..... B65D 75/30 206/308.3
4,565,317 A * 1/1986 Kranz ..... B65D 27/06 229/302
4,586,611 A * 5/1986 Scalzo ..... B65D 27/38 229/316
4,602,736 A * 7/1986 Barr ..... B65D 27/06 229/302
4,613,157 A * 9/1986 Drabish ..... B42D 15/045 229/68.1
4,620,630 A * 11/1986 Moss ..... B65D 75/38 206/308.1

(56) References Cited

U.S. PATENT DOCUMENTS 4,640,030 A * 2/1987 Wood ..... A47G 1/141 229/71
4,651,920 A * 3/1987 Stenner ..... B31B 41/00 229/301
4,653,639 A * 3/1987 Traynor ..... B65D 85/546 206/308.3
4,688,715 A * 8/1987 Barr ..... B65D 27/06 229/302
4,690,322 A * 9/1987 Burns ..... B65D 27/16 229/80
4,706,878 A * 11/1987 Lubotta ..... B42D 15/08 229/304
4,715,531 A * 12/1987 Stewart ..... B65D 27/06 229/306
4,775,095 A * 10/1988 Emmott ..... B65D 27/06 229/303
4,778,100 A * 10/1988 McGuire ..... B65D 27/06 229/303
4,778,101 A * 10/1988 Paquin ..... B65D 27/06 229/303
4,815,654 A * 3/1989 Buescher ..... B65D 27/06 229/305
4,821,439 A * 4/1989 Wilck ..... G09F 3/0288 283/105
4,878,613 A * 11/1989 Badger ..... B42D 15/08 229/75
4,896,823 A * 1/1990 Taylor ..... B42D 5/026 229/303
4,899,926 A * 2/1990 Spaulding ..... B65D 27/06 229/304
4,917,287 A * 4/1990 Watson ..... B65D 27/06 229/303
4,927,072 A * 5/1990 Jenkins ..... B42D 5/025 229/304
4,934,536 A * 6/1990 Mills ..... B42D 5/025 229/301
4,944,449 A * 7/1990 Schmidt ..... B42D 15/08 229/301
4,945,218 A * 7/1990 Talbott ..... G06K 19/04 235/487
4,960,237 A * 10/1990 Bendel ..... B42D 5/026 229/305
4,981,251 A * 1/1991 Jenkins ..... B65D 27/04 229/304
4,993,624 A * 2/1991 Schlich ..... B65D 27/04 229/303
5,024,374 A * 6/1991 Ashby ..... B42D 5/026 229/304
5,025,980 A * 6/1991 Blackman ..... B65D 27/06 229/302
5,039,000 A * 8/1991 Ashby ..... B65D 27/06 229/304
5,040,720 A * 8/1991 Pennock ..... B42D 5/026 229/305
5,052,613 A * 10/1991 Lin ..... B65D 27/06 229/303
5,071,167 A * 12/1991 O'Brien ..... B42D 15/006 283/62
5,071,399 A * 12/1991 Ashby ..... B65D 27/06 493/216
5,104,036 A * 4/1992 Rutkowski ..... B65D 27/06 229/301
5,110,043 A * 5/1992 Ashby ..... B42D 5/026 229/303
5,118,030 A * 6/1992 McNamara ..... B42D 5/026 229/305
5,118,031 A * 6/1992 Tighe ..... B42D 15/045 229/301
5,125,562 A * 6/1992 Bendel ..... B42D 15/08 229/301
5,163,612 A * 11/1992 Ashby ..... B65D 27/06 229/301
5,197,663 A * 3/1993 Stude ..... B65D 27/06 229/301
5,201,464 A * 4/1993 File ..... B42D 15/08 229/304
5,209,698 A * 5/1993 Dolan ..... B42D 5/025 281/2
5,213,258 A * 5/1993 Kim ..... B65D 75/66 229/301
5,224,647 A * 7/1993 Yanow ..... B65D 27/06 229/302
5,232,150 A * 8/1993 Solomons ..... B65D 27/06 229/302
5,248,032 A * 9/1993 Sheu ..... B65D 85/546 206/308.1
5,251,810 A * 10/1993 Kim ..... B65D 27/06 229/303
5,253,803 A * 10/1993 Chess ..... B65D 27/06 229/305
5,267,687 A * 12/1993 Sherman ..... B65D 27/06 229/305
5,271,553 A * 12/1993 Kim ..... B65D 77/32 229/303
5,277,362 A * 1/1994 Wilson ..... B65D 27/06 229/304
5,282,568 A * 2/1994 File ..... B42D 15/08 229/304
5,288,014 A * 2/1994 Meyers ..... B31B 1/62 229/304
5,299,979 A * 4/1994 Ballard ..... G09F 3/0288 283/81
5,307,989 A * 5/1994 Dyer ..... B42D 5/026 229/304
5,318,222 A * 6/1994 Bartlett ..... B42F 7/02 206/308.3
5,324,927 A * 6/1994 Williams ..... B07C 3/18 209/584
5,333,909 A * 8/1994 Hedge, Jr. ..... B42D 15/00 281/15.1
5,383,686 A * 1/1995 Laurash ..... B42D 15/006 283/101
5,400,957 A * 3/1995 Stude ..... B65D 27/06 229/302
5,415,341 A * 5/1995 Diamond ..... B65D 27/00 229/302
5,431,337 A * 7/1995 Bell ..... B65D 27/06 229/305
5,458,273 A * 10/1995 Schubert ..... B42D 5/025 229/304
5,487,826 A * 1/1996 Back ..... B65D 27/16 206/308.3
5,501,393 A * 3/1996 Walz ..... B42D 5/02 229/300
5,503,328 A * 4/1996 Roccaforte ..... B65D 27/06 229/301
5,516,040 A * 5/1996 Lin ..... B65D 27/06 229/302
5,520,990 A * 5/1996 Rotermund ..... B42D 15/006 281/5
5,547,227 A * 8/1996 Laurash ..... B42D 15/006 229/300
5,553,774 A * 9/1996 Goodno ..... B42D 5/026 229/303
5,570,835 A * 11/1996 Sung ..... B65D 27/34 229/301
5,626,286 A * 5/1997 Petkovsek ..... B42D 15/08 229/300
5,626,370 A * 5/1997 Petkovsek ..... B42D 15/006 229/300
5,662,420 A * 9/1997 Sinda ..... B65D 81/03 206/521
5,683,029 A * 11/1997 Lyons ..... B65D 27/38 229/309
5,687,904 A * 11/1997 Potter ..... B65D 27/06 229/303
5,690,220 A * 11/1997 Swan ..... G11B 33/0422 206/308.1

(56) References Cited

U.S. PATENT DOCUMENTS 5,697,496 A * 12/1997 Bauer ..... B65D 85/548 206/308.1
5,704,543 A * 1/1998 Pollanen ..... B65D 27/06 229/303
5,713,511 A * 2/1998 Diamond ..... B65D 27/06 229/302
5,722,538 A * 3/1998 Neely ..... B65D 65/42 156/277
5,752,647 A * 5/1998 Schubert ..... B42D 15/08 229/300
5,823,423 A * 10/1998 Murray ..... B65D 27/34 229/303
5,826,787 A * 10/1998 Turner ..... B65D 27/04 229/302
5,862,978 A * 1/1999 Forrest ..... B42D 5/026 229/300
5,875,964 A * 3/1999 Pham ..... B65D 27/06 229/302
5,887,780 A * 3/1999 Popat ..... B65D 27/10 229/69
5,887,904 A * 3/1999 Petkovsek ..... B42D 5/02 281/2
5,901,843 A * 5/1999 Gambardella ..... B65D 85/546 206/308.1
5,901,844 A * 5/1999 Gambardella ..... B65D 85/546 206/308.1
5,909,805 A * 6/1999 Neely ..... B65D 65/42 206/308.1
5,929,415 A * 7/1999 Berson ..... B07C 1/00 209/564
5,950,916 A * 9/1999 Santangelo ..... B65D 27/06 229/301
5,967,403 A * 10/1999 Kranz ..... B65D 27/06 229/305
6,053,855 A * 4/2000 Stenner ..... B31B 41/00 229/300
6,059,316 A * 5/2000 Whittington ..... B42D 1/007 206/308.1
6,070,792 A * 6/2000 Foushee ..... B65D 27/06 229/302
6,129,269 A * 10/2000 Tait ..... B65D 27/06 229/301
6,129,389 A * 10/2000 Younger ..... B42D 5/026 229/304
6,155,481 A * 12/2000 Rawlings ..... B65D 27/06 229/300
6,170,879 B1 * 1/2001 Rawlings ..... B42D 15/006 283/101
6,173,888 B1 * 1/2001 Fabel ..... B42D 15/08 229/304
6,179,202 B1 * 1/2001 Alexander ..... B42D 15/00 229/300
6,196,447 B1 * 3/2001 Purcell ..... B65D 27/00 229/70
6,220,504 B1 * 4/2001 Flynn ..... B65D 27/34 206/308.1
6,223,977 B1 * 5/2001 Hill ..... B65D 27/34 229/313
6,237,844 B1 * 5/2001 Purcell ..... B65D 27/00 206/804
6,254,138 B1 * 7/2001 Rawlings ..... G09F 3/0288 283/101
6,296,179 B1 * 10/2001 Wortman ..... B65D 27/06 229/306
D451,131 S * 11/2001 Okah Chegwe-Akigbe .... D19/3
6,361,077 B1 * 3/2002 Petkovsek ..... G07B 17/00508 229/300
6,402,022 B1 * 6/2002 Fabel ..... B41L 1/22 229/303
6,409,075 B1 * 6/2002 Mehta ..... B42D 15/08 229/92.1
6,435,404 B1 * 8/2002 Feick ..... B65D 27/04 229/303
6,481,754 B2 * 11/2002 Fabel ..... B41L 1/22 229/314
6,612,484 B2 * 9/2003 Rawlings ..... B42D 15/08 229/305
6,725,587 B2 * 4/2004 Collins ..... G09F 1/00 40/124.06
D510,383 S * 10/2005 Potter ..... D19/3
6,966,484 B2 * 11/2005 Calonje ..... B65D 27/06 229/305
6,983,875 B2 * 1/2006 Emmott ..... B65D 5/54 229/313
D536,375 S * 2/2007 Potter ..... D19/3
7,201,305 B1 * 4/2007 Correa ..... B42D 5/026 229/305
7,350,689 B1 * 4/2008 Campbell ..... B65D 27/06 229/301
7,438,213 B2 * 10/2008 Ackley ..... B65D 27/06 229/300
7,467,747 B2 * 12/2008 Haas ..... B65D 27/12 229/300
7,469,816 B2 * 12/2008 Rosenkranz ..... B65D 27/06 229/303
7,568,613 B1 * 8/2009 Dillon ..... B65D 27/06 229/305
7,644,004 B2 * 1/2010 Guyett ..... G07B 17/00467 229/300
7,866,467 B2 * 1/2011 Rosenkranz ..... G06Q 10/087 206/308.1
2002/0008135 A1 * 1/2002 Kim ..... B65D 27/06 229/303
2002/0023948 A1 * 2/2002 Gillespie, IV ..... B65D 27/06 229/70
2002/0130169 A1 * 9/2002 Purcell ..... B65D 27/38 229/309
2004/0050918 A1 * 3/2004 DeLaVergne ..... B65D 27/06 229/305
2004/0112946 A1 * 6/2004 Smythe ..... B31B 41/00 229/71
2005/0045707 A1 * 3/2005 Stude ..... B65D 27/14 229/308
2005/0184140 A1 * 8/2005 DeLa Vergne ..... B65D 27/06 229/301
2006/0208053 A1 * 9/2006 Emmott ..... B65D 27/06 229/305
2006/0219769 A1 * 10/2006 DeLaVergne ..... B65D 27/06 229/301
2006/0266808 A1 * 11/2006 DeLaVergne ..... B65D 27/06 229/72
2008/0041928 A1 * 2/2008 DeLaVergne ..... B65D 27/04 229/301
2010/0038414 A1 * 2/2010 DeLaVergne ..... B42D 15/045 229/305
2010/0219233 A1 * 9/2010 Rosen ..... B65D 27/04 229/301

* cited by examiner

CONVERSION ENVELOPES

CROSS-REFERENCE TO RELATED APPLICATIONS

The present application claims priority to and is a Continuation-in-part of co-pending U.S. patent application Ser. No. 12/708,551 filed Feb. 19, 2010 and issued Nov. 4, 2014 as U.S. Pat. No. 8,875,985 of like title, and claims the benefit under 35 U.S.C. 119(e) of provisional application No. 61/208,011, filed Feb. 19, 2009, the entire contents of each which are incorporated herein by reference in entirety.

TECHNICAL FIELD

The present invention relates to envelopes that are sent as a first size envelope and returned as a second smaller size envelopes making the returned envelope compatible for remittance machines. In one manifestation, the present invention may also provide envelopes having a security tab and/or bridge structure formed by removing a tear strip on the envelope, allowing access into the envelope.

BACKGROUND

For statement and similar mail, such as might be used by telephone companies, utility companies and others who send several statement pages to each customer, a smaller businesses size envelope such as a number 10 may not be large enough. A larger size envelope referred to as a flat or half flat size envelope then typically may be used for these mailings. However, large envelopes of sizes such as a 9"×12" or a 6"×9" are typically not used for sending transactional mail to a lock box or remittance center, such as when a customer sends a payment or a direct mail solicitation reply by mail. Instead, and typically included in a statement mailing such as described, a separate reply envelope for the customer to return their payment to complete the transaction is included.

The main reason a reply envelope is added is because the larger envelopes are not the appropriate size for most high-speed automated remittance equipment. They are taller than the desired height of approximately 3.5" to 4.4". The reply envelope is only needed for remittance and adds costs because it is a separate envelope that needs to be manufactured, printed, shipped, stored, and inserted. Generally when a customer sends a payment for a bill or invoice by mail they send a payment coupon with their check in the reply envelope. A larger envelope that can carry multiple pages on the outgoing mailing is not required for the return when a single check and coupon are returned. For this purpose a smaller envelope is sufficient. In addition, a smaller reply envelope fits the optimal size requirements for remittance equipment, allowing the most efficiencies and cost savings for returned mail.

A majority of mail that is returned for paying a bill or responding to a solicitation is what is referred to as a reply envelope. The typical reply envelope is a No. 9 envelope which is approximately 3.875 inches high. Because there is a general conformity for the standard reply envelope size, companies responsible for collecting and processing the return mail optimize their machines to this standard size for speed and accuracy. Sizes outside the standard size are either unable to be processed through automated equipment or can slow the automated process down, costing companies extra money in processing and delaying payment from the customer. Thus a larger envelope for the outgoing is not feasible for remittance and a smaller reply size helps to ensure automated remittance processing and on time banking and payment.

SUMMARY

Accordingly, the present invention provides a larger size envelope for sending the mail and a smaller size envelope for remittance that are functionally combined into a single envelope. A larger envelope is used to send multiple page documents and a smaller envelope is used to return the remittance statement and the payment. Thus, according to the present invention a large envelope is uniquely converted down to a smaller remittance size envelope for the return.

According to the present invention, only one envelope instead of two envelopes is required for both sending and returning, instead of one large envelope and one smaller envelope provided within the large envelope. This unique design can be applied to all sizes of envelopes and is not limited to any particular size of envelope. Converting a larger envelope to a smaller return envelope in accordance with the present invention enables automated remittance processing, saves money, preserves natural resources, and is a unique way to send statements, surveys, and direct mail that require a return mailing.

Additionally, conversion envelopes in accordance with the present invention include a simple method for removing barcodes commonly sprayed on the envelope. By removing an opening strip on the front and by removing the lower portion of the envelope, any barcodes applied can be removed. Envelopes and related methods of managing removal and/or obscuring of such barcodes are also described in Applicant's copending non-provisional patent application publication No. 2008/0041928, having Ser. No. 11/893,562, entitled "Reusable Envelope Structures and Methods", filed on Feb. 24, 2005, the entire disclosure of which is incorporated herein by reference for all purposes. In addition to the foregoing patent application, other patent applications currently pending and assigned to the present assignee which have teachings that are or may be relevant to the present invention, the entire disclosure which is hereby incorporated by reference, include Ser. No. 14/321,784 entitled "Reusable Envelope Structures and Methods" filed Jul. 1, 2014; Ser. No. 13/488,928 entitled "Reusable Envelopes" filed Jun. 5, 2012; and Ser. No. 14/526,506 entitled "Expedited Two-Way Auto-Insertion Mailer" filed Oct. 28, 2014.

BRIEF DESCRIPTION OF THE FIGURES

The accompanying drawings, which are incorporated in and constitute a part of this disclosure, illustrate several aspects of the present invention and together with description of the exemplary embodiments serve to explain the principles of the present invention.

DETAILED DESCRIPTION

The exemplary embodiments of the present invention described herein are not intended to be exhaustive or to limit the present invention to the precise forms disclosed in the following detailed description. Rather the exemplary embodiments described herein are chosen and described so those skilled in the art can appreciate and understand the principles and practices of the present invention.

Figure 1:
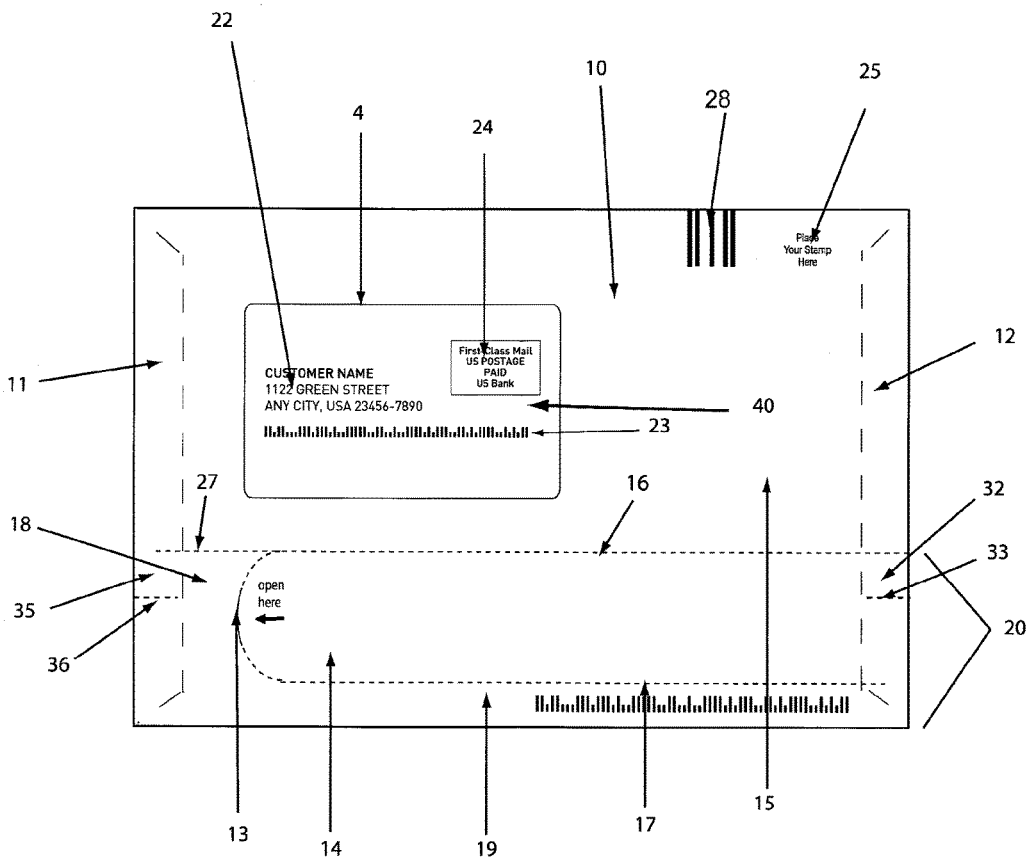
FIG. 1 is a view of the front of an exemplary reusable conversion envelope in accordance with the present invention showing a front panel with an upper portion of the envelope with a window, FIM, and postage area, a lower portion with a tab, a strip between two spaced apart perforations, a bridge portion to the left of the tab, and bottom edge lip below the tear off strip. For purpose of illustration a POSTNET barcode is shown in the lower right corner. In the window, the return address, the mailing address and the postage indicia is shown.
Figure 2:
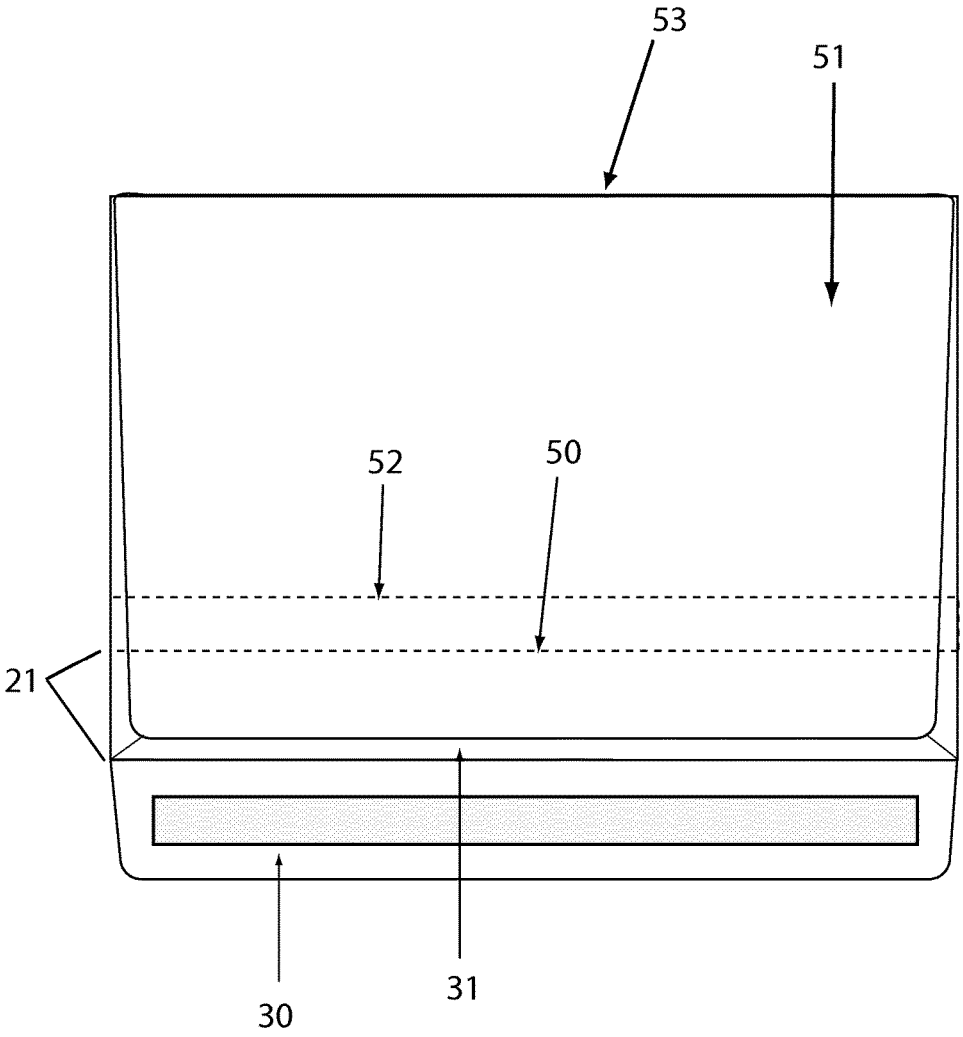
FIG. 2 shows the back of the exemplary envelope with the original seal flap on the bottom, and a perforation and a score line parallel to each other across the back panel.
Figure 3:
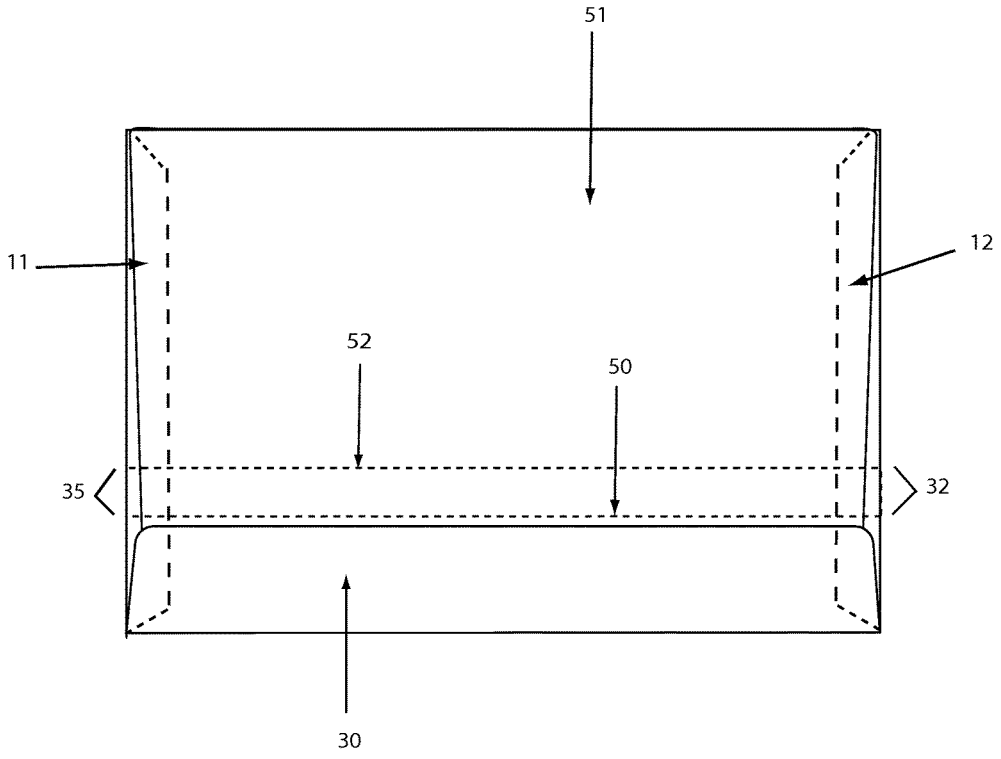
FIG. 3 shows the original seal flap sealed to the back panel.
Figure 4:
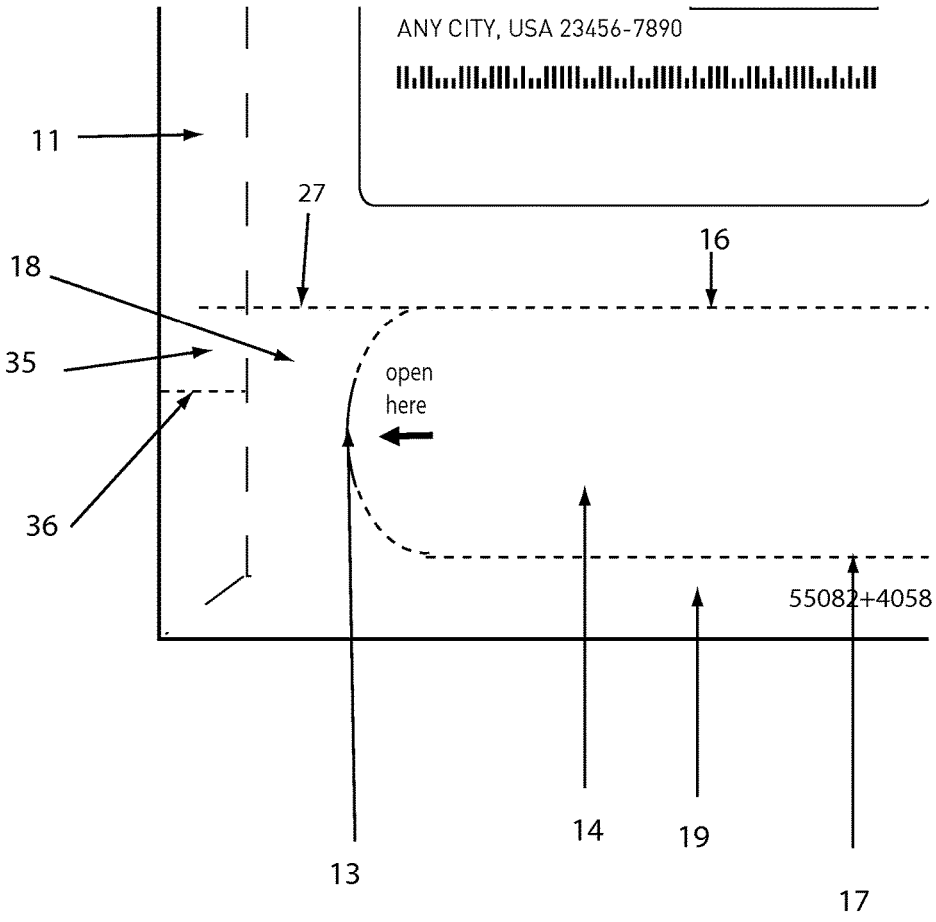
FIG. 4 shows the die cut tab for lifting the strip to open the envelope. The words "open here" with an arrow are also shown.
Figure 5:
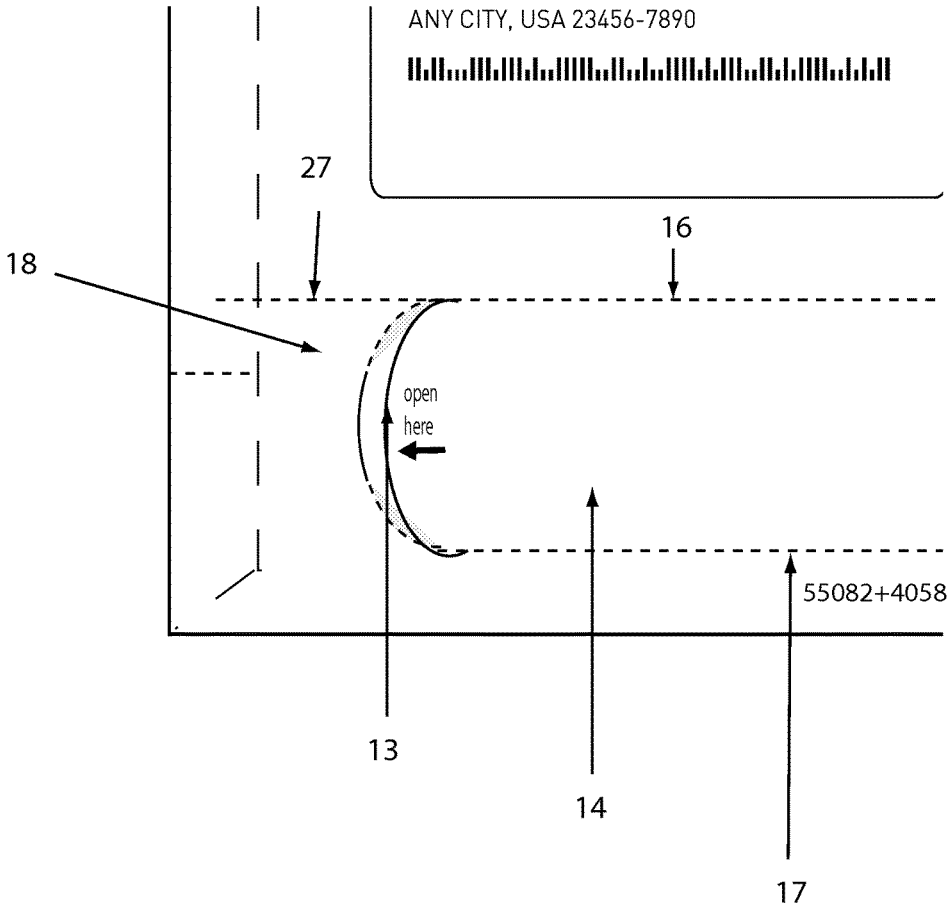
FIG. 5 shows the tab being lifted to begin the removal of the perforated opening strip.
Figure 6:
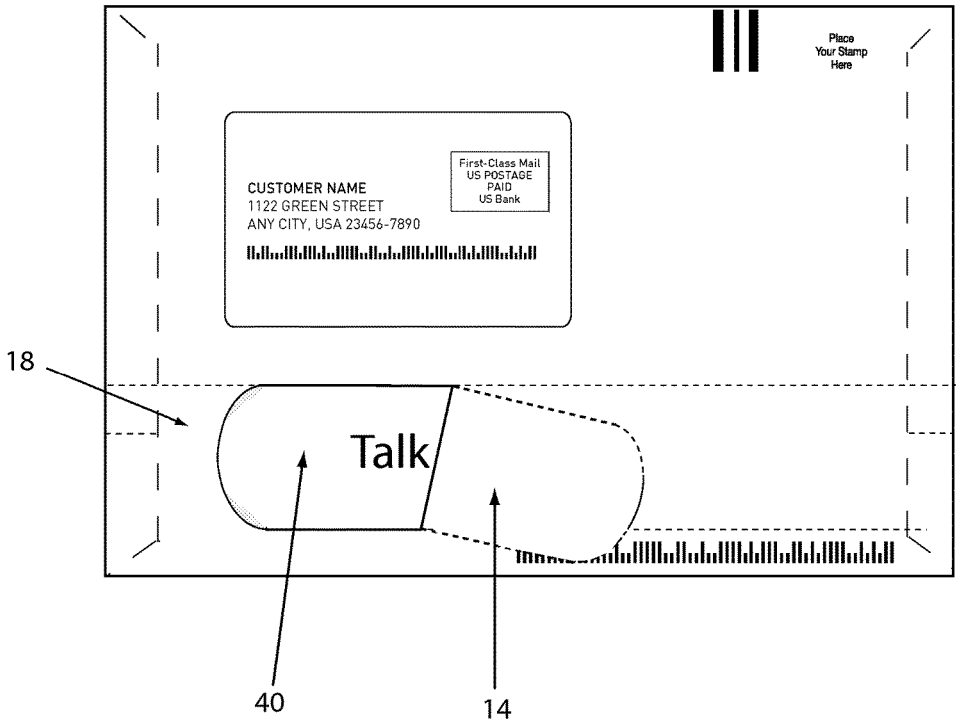
FIG. 6 shows the perforated opening strip on the front panel partially removed. Removing the strip, in the illustrated embodiment, reveals marketing information that is placed under the removable strip for introducing an offer, or bringing attention to some significant information for the receiver.
Figure 7:
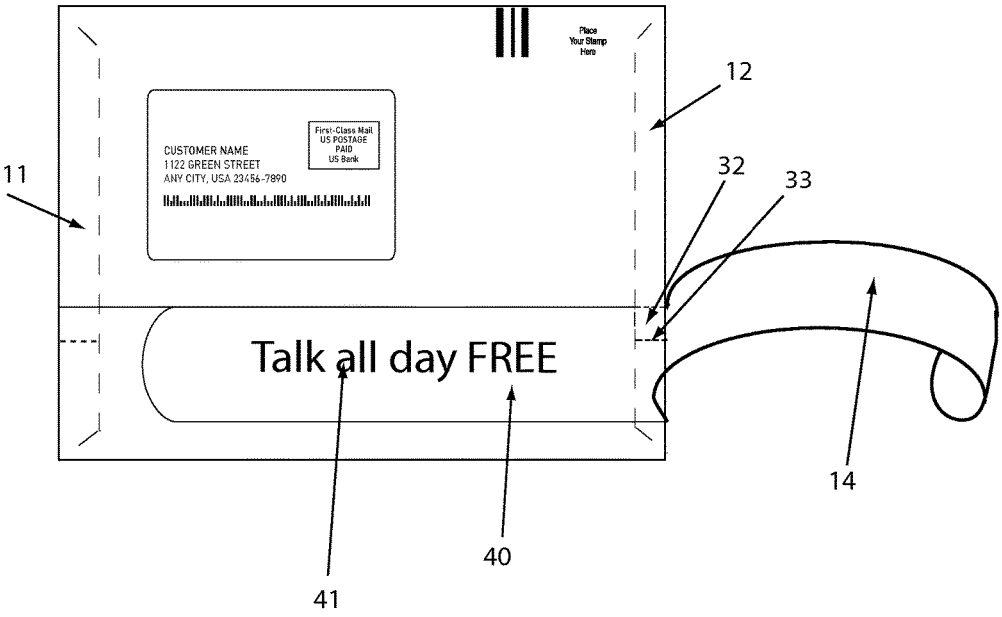
FIG. 7 shows the opening strip torn from the front panel of the exemplary envelope revealing the full message or offer printed on the insert (if used). By pulling off the opening strip the bridge portion and bottom edge lip is created. The bridge and lip hold in the contents of the envelope for security.
Figure 8:
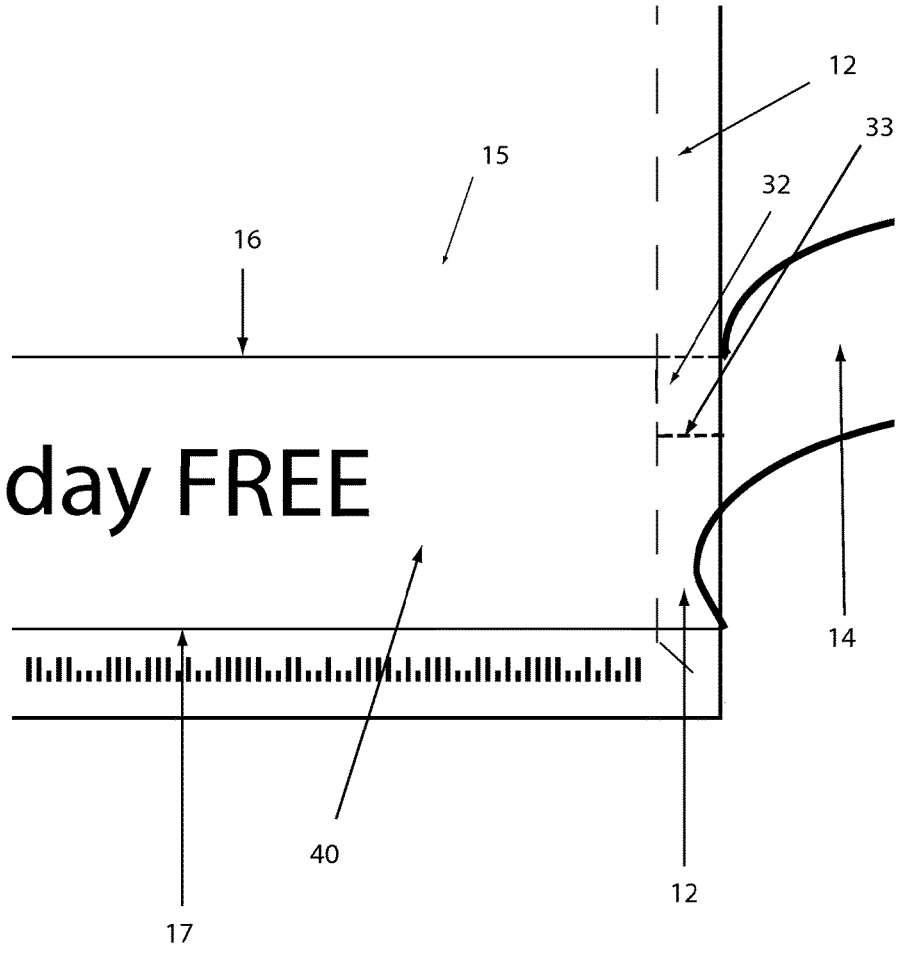
FIG. 8 shows the section of the side seam that is connected to the perforated opening strip. The illustration shows the perforations for easily removing the side seam section when the opening strip is pulled off.
Figure 9:
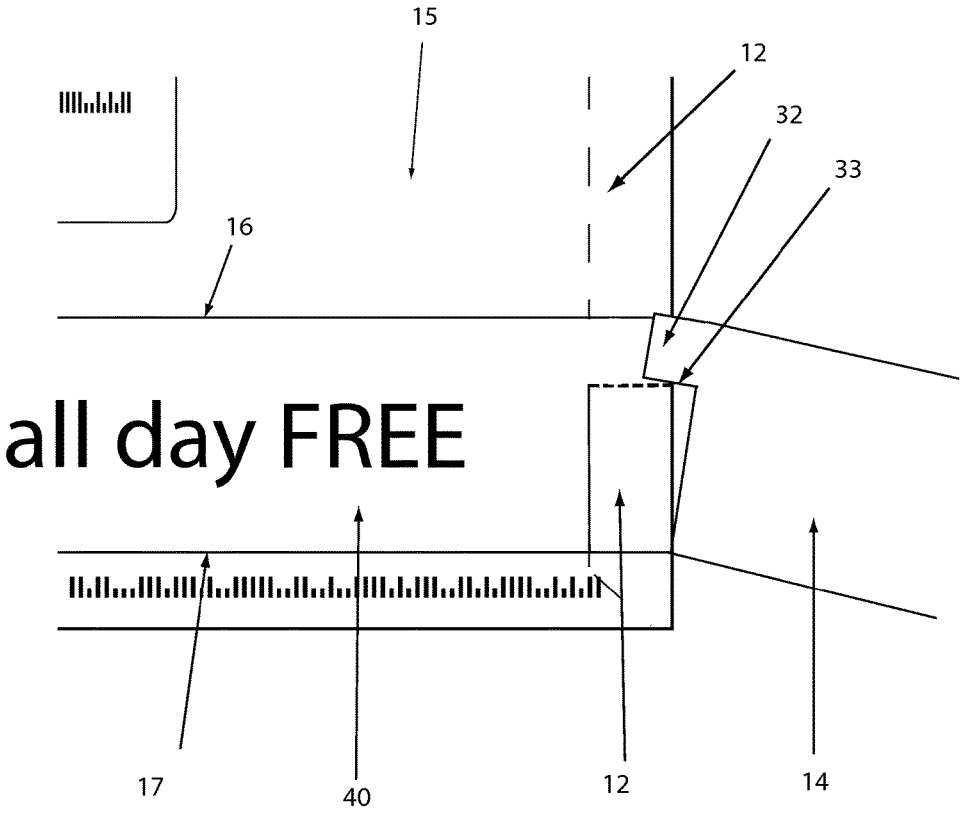
FIG. 9 illustrates how the section of the side seam is removed along the perforations by the opening strip.
Figure 10:
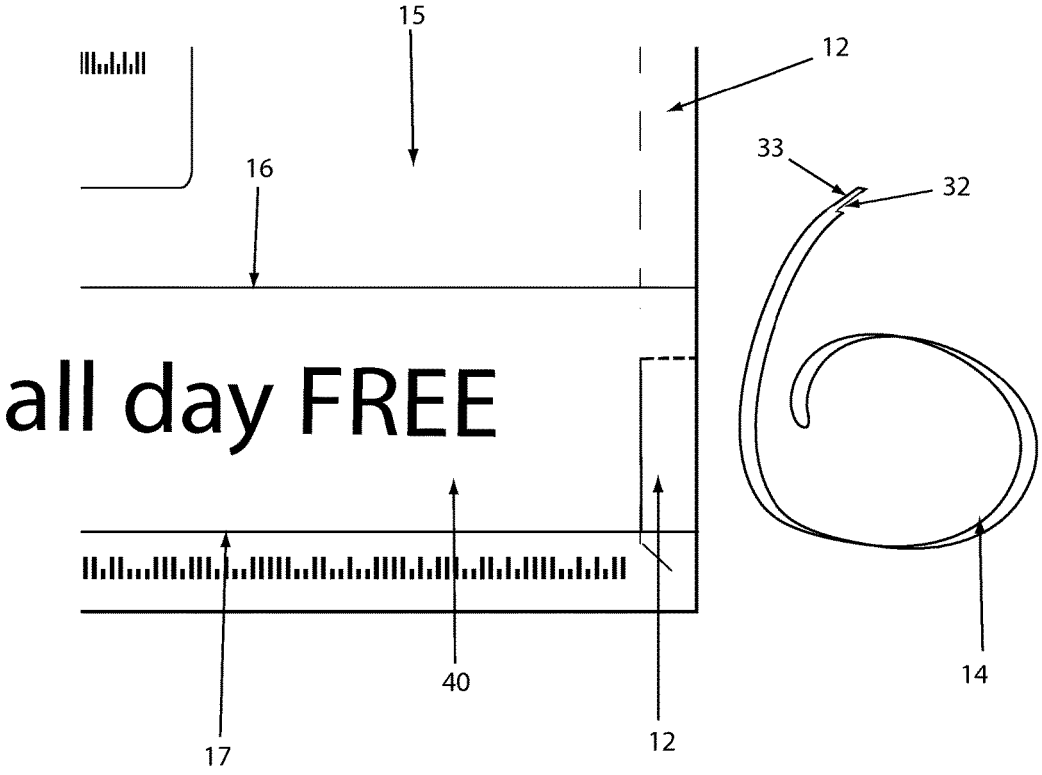
FIG. 10 shows the perforated opening strip and the section of the side seam removed so the side of the second seal flap is created.
Figure 11:
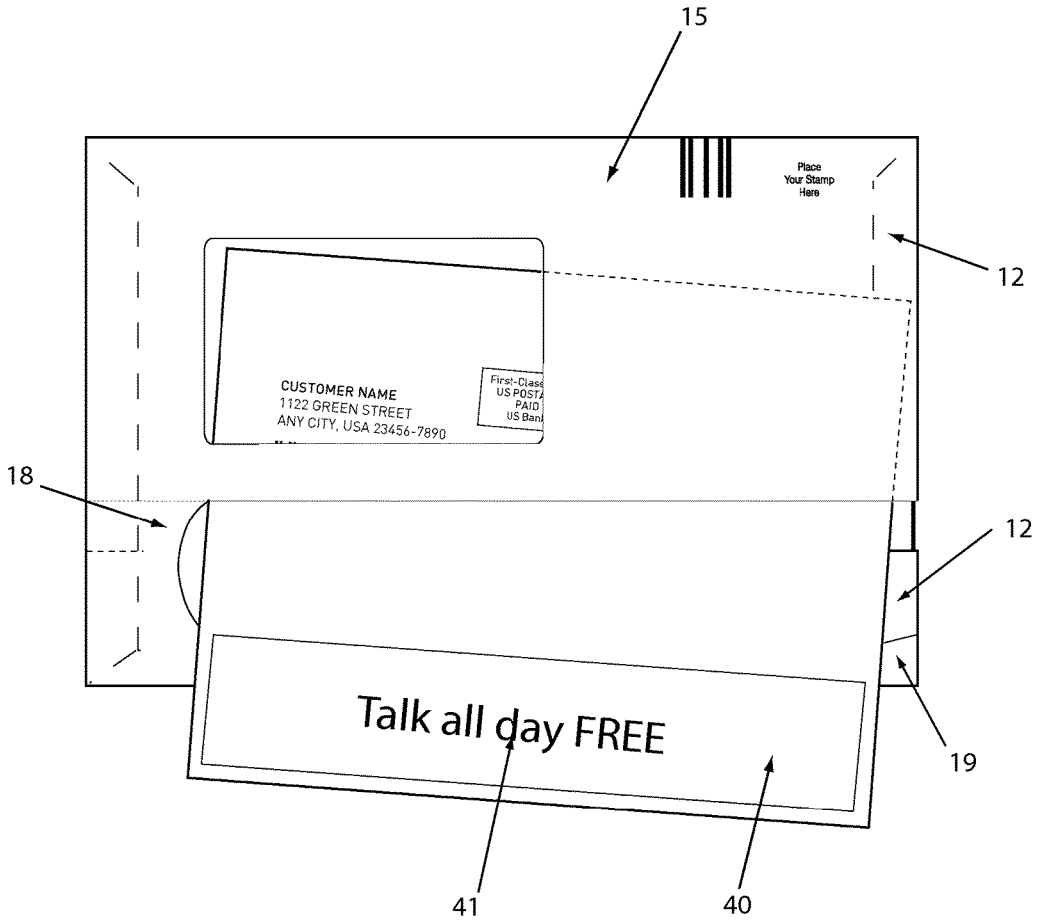
FIG. 11 shows the contents lifted over the bottom edge lip through the opening created by the perforated tear strip.
Figure 12:
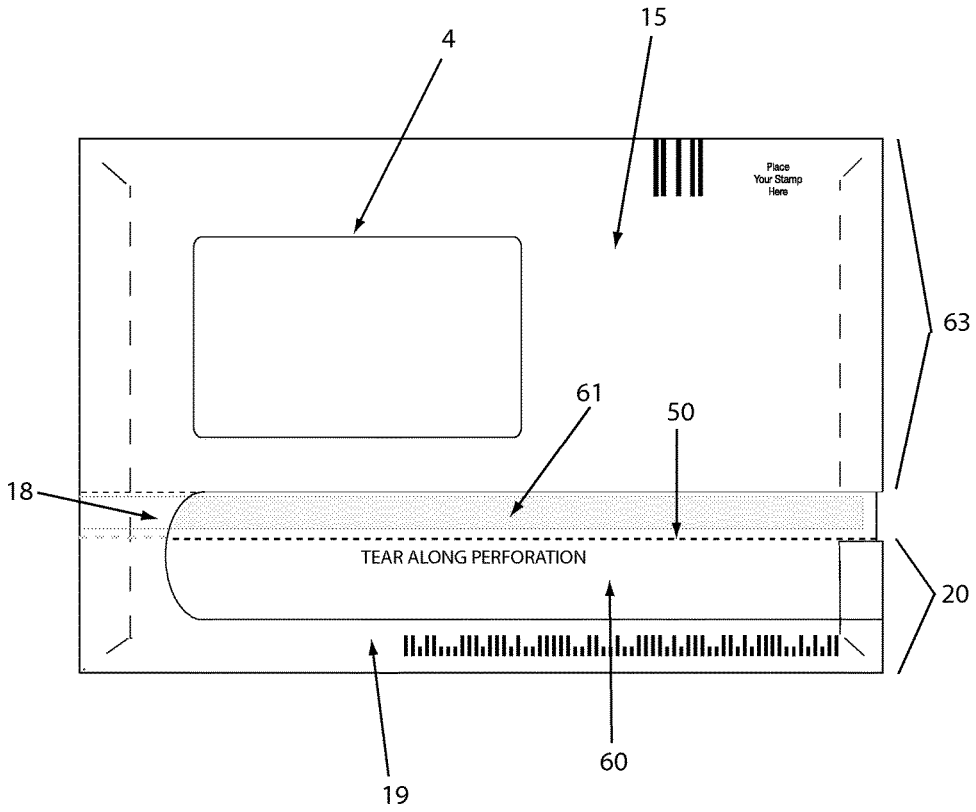
FIG. 12 shows that after the inserted material is removed a reply seal flap is apparent. Visible is a glue strip between a parallel perforation and a score line on the inside of the back panel. Also visible are the instructions, "Tear along perforation" and arrows pointing to the perforation.
Figure 13:
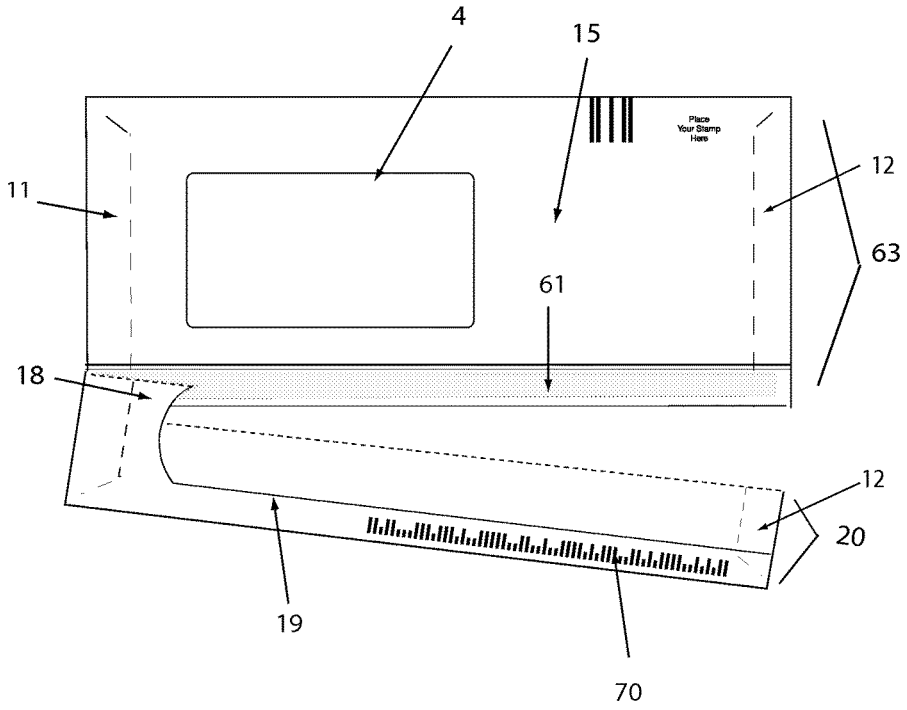
FIG. 13 illustrates the lower portion with the bridge and lip being torn along the perforation in the back panel.
Figure 14:
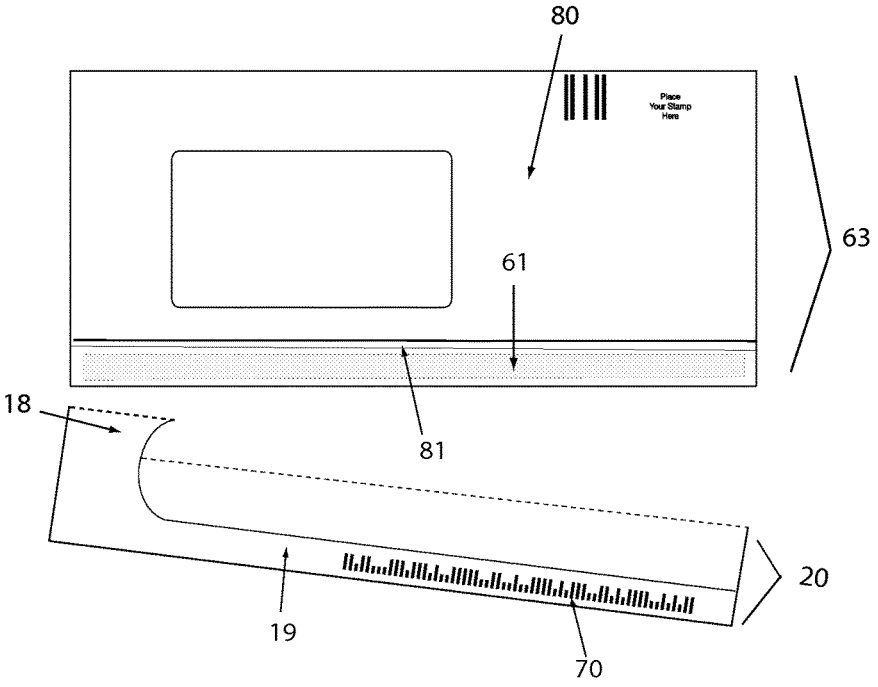
FIG. 14 shows the lower portion of the exemplary envelope completely detached from the upper portion of the envelope. Removing the bridge and the section of the side seam on the left creates the left side of the reply envelope seal flap. Now visible is the reply envelope with the seal flap on the bottom ready to resend. Removing the lower portion of the envelope removes any barcodes that may have been sprayed on either the front or the back lower portion of the envelope. The barcodes remain with the lower portion that is discarded. Removing the barcodes is required for reusable envelopes to prevent the mail piece from looping back to the recipient when mailed a second time.
Figure 15:
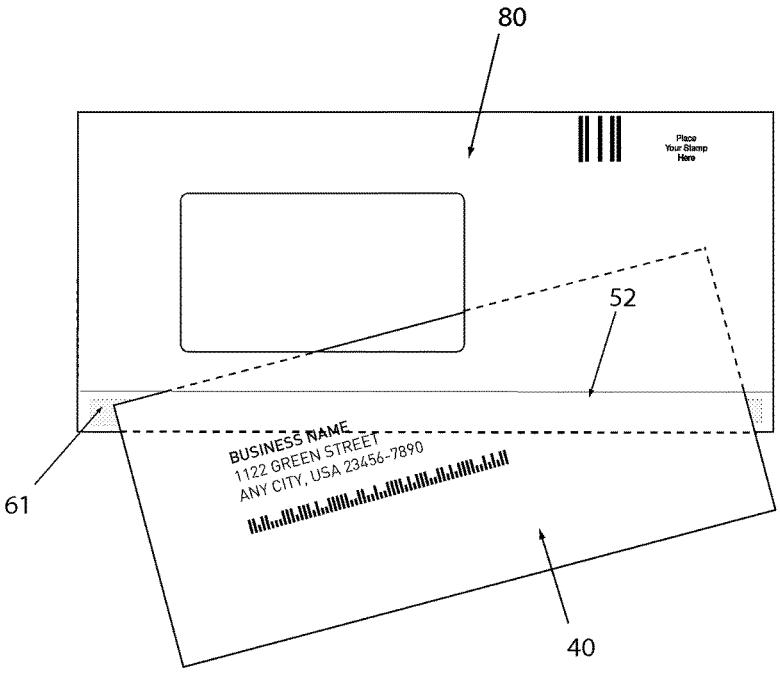
FIG. 15 shows the coupon for remittance being placed in the smaller reply envelope. The address will be visible in the original window.
Figure 16:
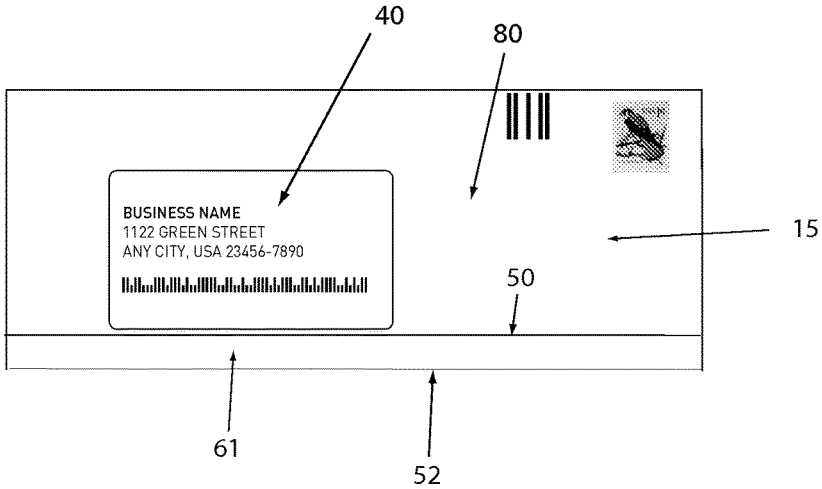
FIG. 16 shows the converted smaller reply envelope ready to be mailed. The coupon is in the envelope with the return address showing through the window, the second seal flap is folded up and attached to the front panel, and a postage stamp is placed in the upper right corner for delivering the mail.

The present invention provides a unique way to convert a first mailing envelope such as a 6"×9" size envelope illustrated by reference numeral 10 in the Figures to a smaller reply envelope 80 visible for example in FIG. 14 that is compatible with remittance processing for managing reply mail for statement mail and direct mail. Unique in this approach is the removal of a section of both left 11 and right 12 side seams to form part of the reply envelope seal flap 61. When a recipient receives envelope 10, the recipient lifts a tab 13 and tears a section 14 of the front panel 15 along perforations 16, 17 to open the envelope. Perforations 16, 17 are illustrated in the preferred embodiment envelope 10 as being generally parallel, but it will be understood that other arrangements may be made, and as may be desired by those skilled in the art upon a reading of the present disclosure.

The perforated opening strip 14 may be connected to a section of the side seam 32 when the opening strip is pulled off, as illustrated for exemplary purposes in preferred embodiment envelope 10. After perforated strip 14 has been pulled off, a bridge portion 18 and the bottom edge with a lip 19 is created. The bridge portion 18 and bottom edge lip 19 are part of the lower portion 20 of front panel 15 of the envelope. The original seal flap 30 is attached to the lower portion 21 of the back panel 51 on the bottom.

In accordance with the present invention the bridge 18 and lip 19 each function uniquely, both independently of each other and synergistically in combination, to keep the contents of envelope 10 from falling out if opening strip 14 is accidentally removed in mail processing or delivery. The bridge portion 18 is also connected to a section of side seam 11 opposite from the section of the side seam 12 removed by opening strip 14. After envelope 10 is opened and contents 40 are lifted out, smaller reply envelope 80 is created from the original larger envelope 10 by tearing the lower portion 20 of envelope 10 along a perforation 50 in the back panel 51 visible from the inside when contents 40 are removed. Removing the lower portion 20 by tearing along perforation 50 in back panel 51 removes bottom edge lip 19, bridge portion 18 and the side seam section 35 connected to bridge portion 18, as well as the original seal flap 30 attached to the lower portion 21 of back panel 51. Removing both sections of the side seams 32, 35 forms the edges of the reply envelope seal flap 61. Removing the lower portion 20 of the original envelope 10 forms the edge of seal flap 61 for sealing reply envelope 80 for the return trip.

When the lower portion 20 is released from envelope 10, what remains is the smaller reply envelope 80 with a seal flap 61 on the bottom, the original window 4, and the upper section 63 of the original pocket 31 of the envelope 10. To resend the new converted reply envelope 80, seal flap 61 is folded up and attached to front panel 15. In addition, by removing the lower portion 20 of the envelope, barcodes 70 the USPS may spray on the envelope are uniquely removed both on the front lower portion 20 and the back lower portion 21 of the envelope, preventing the newly created reply envelope 80 from looping. Looping is a phenomenon that occurs when a barcode that has been sprayed on an envelope by the USPS designates the present sender of the envelope, meaning the mail is returned to the sender rather the being delivered to the intended recipient. This can create very undesirable delay and added expense in the delivery of the envelope to the intended recipient. By removing any barcodes when the lower portion 20 of the preferred envelope 10 is removed, there is no chance for looping to occur.

A larger envelope such as a 6×9 or 9×12 that can carry multiple statement pages is often used for outgoing statement mail. Generally when a customer sends a payment for a bill or invoice by mail they send a payment coupon with their check in a reply envelope included with the statement. In this case, the larger outgoing envelope is impractical, potentially costly due to increased return postage, and too large to return only a coupon and check. Furthermore, the larger size does not fit most automated remittance machinery. For remittance of a coupon and payment a smaller reply envelope is an optimal size required for remittance equipment, allowing the highest efficiencies and cost savings for processing reply mail.

Most mail that is returned for paying a bill or responding to a solicitation generally uses a No. 9 size reply envelope for which the standard size is approximately 8⅝" wide×3⅞" high. Because there is a general conformity for this size envelope as the standard reply envelope size, companies responsible for collecting and processing the return mail optimize their machines to a standard size for speed, accuracy, and reporting of payments collected. Sizes outside a standard size cannot be automatically processed or slow the process down, costing companies extra money in processing and sometimes delaying payment from the customer. Thus, a larger envelope for the outgoing envelope is not optimal for remittance and a smaller reply size is critical to ensure on-time processing and payment.

In accordance with the present invention, a larger size envelope for sending mail such as statements and the like and a smaller size envelope for remittance are combined into one envelope. In this way only one reusable conversion envelope instead of two envelopes is needed. Converting a larger envelope to a smaller return envelope saves money, preserves natural resources, and is a unique way to send statements and direct mail that require a return mailing. In addition, the present reusable conversion envelope does not disrupt mailing processes because the envelope fits the specifications for outbound mail, and when converted for return mail, fits the specifications for current remittance technology.

Conventionally, whenever a large envelope is sent through the mail with some portion of the contents to be returned, a second envelope is placed in the originating envelope and used for returning a payment or other contents as prescribed. The method of sending and returning contents of mail is common. Also common is a reply envelope included with mail for customers to return a portion or all of the contents of the original mailing. Statement mail has an outer envelope and a reply envelope and is an example of this type of mailing. It is also known that sending a separate reply envelope prevents mail from looping back or being delivered to the sender if the USPS sprays barcodes on the front and back of the originating envelope.

Reply envelopes typically used for sending return mail such as payment coupons are designed to be a certain size to fit inside a carrier envelope and to run efficiently on remittance machines such as OPEX™ machines. Conforming to a specific size for reply mail for large statement mailers or direct mailers allows the processing of return mail to be mechanized and to run in a streamlined and uninterrupted manner, saving time and resources for receiving and banking payments or payment for fulfillment of an order. When statement mailers mail multiple page statements, a larger size envelope is required. For remittance in such a case a smaller envelope is added at an extra cost to the mailer. Having the correct size envelope for remittance keeps the remittance process—a time sensitive process—efficient, accurate, and keeps cost down. This is an important consideration for companies to determine revenue and record the customer payment. For this reason, envelopes compatible with current remittance technology are critical. A conversion envelope that originates as a larger envelope for outgoing mail that converts to a smaller reply envelope for the return that is compatible with remittance technology and saves the cost of a reply envelope is desirable because such envelopes saves time, money, and reduces the amount of paper needed to send transactional mail.

Conventional envelope manufacturing die cuts an envelope shape from sheets or rolls of paper. The cut out envelope shape is referred to as the blank. The blank is folded to create a pocket with a closure device. Generally there is a front panel, back panel, two side seams, generally one on the right and one on the left, and a remoistened or adhesive seal flap that extends from either the front or the back panel and folds over the opening and attaches to the opposite panel to close the envelope. To create an envelope, the back panel and front panel are folded together, the side seams are folded and glued to the back panel to create the pocket and the seal flap extends beyond the opening attaching either the front or the back panel.

Envelopes in accordance with the present invention include a front panel 15 and a back panel 51. Extensions of front panel 15 include side seams on the right 12 and the left 11 and a seal flap 30 extending from the bottom of the front panel 15. Preferred envelope 10 has opening 31 at the bottom. Nevertheless, the outgoing envelope opening 31 may alternatively be provided through an additional flap and adhesive strip at the top.

In accordance with the present invention, side seams 11, 12 are glued to back panel 51 with the exception of a section that is defined by parallel perforations 33, 36 on both the right and left side seams 11, 12. The unglued section of side seams 32, 35 are in the same location on the left and right sides. As described below, when the unglued sections 33, 36 of the side seams sections on both sides of the envelope are removed, the reply envelope seal strip 61 left and right sides are defined. All other sections of the side seams 11, 12 on the left and right are glued to back panel 50 to create the pocket 31 of the envelope.

In accordance with the present invention, the side seam sections 32, 35 that are removed could have been die cut during the stage when the envelope shape is cut out during manufacturing. In high speed inserting it is critical there are no opportunities for materials to get caught on edges or openings resulting in jams or slow-downs. By leaving the unglued sections in the two side seams the possibility of materials getting caught in the edges of the side seam when the envelope is inserted is eliminated. If the side seam sections were cut out, edges from the cuts could catch inserted materials, causing a jam on high speed inserting equipment. Having the side seam function as one continuous side seam keeps the design within acceptable specification for high speed insertion. The sections that are not glued 32, 35 and are perforated 33, 36 do not interfere with the inserting process. These sections 32, 35 are uniquely designed to be easily removed in the process of opening the envelope and when the lower portion of the envelope is removed, forming the reply envelope as described in this patent. Having the side seam function as one continuous side seam is a very important feature for high speed inserting because it reduces the possibility of materials getting caught when inserted. In addition, removing the side seam sections is an important feature for converting a larger envelope to a smaller reply envelope as described herein.

Most conventional envelopes have the opening to the pocket of the envelope at the top. The seal flap folds from the front panel over the opening at the top and attaches on the back panel of the envelope. In the preferred embodiment, the opening to pocket 31 is on the bottom and seal flap 30 that is also on the bottom folds over the opening and attaches to the lower portion of back panel 51. In an alternative embodiment, the outgoing opening and seal flap may instead be provided at the top of the envelope.

The front of the envelope is similar to other reusable envelopes and in the preferred embodiment for exemplary purposes is illustrated with a window 4 and FIM 28 (Facing Identification Mark allowed by the USPS on outgoing presorted mail for reusable envelopes. SEE Postal Bulletin February 2007). While a window is illustrated in the preferred embodiment, it will be understood that alternative addressing techniques may be provided, for exemplary and non-limiting purposes such as illustrated in commonly assigned U.S. Pat. No. 7,549,571, the teachings and contents which are incorporated herein, and in commonly assigned patent application Ser. No. 14/526,506 incorporated by reference herein above. In an alternative embodiment, multiple windows may be provided. Likewise, while FIM 28 is illustrated, it will be understood that other similar or equivalent marks may be used, or, where desired for a particular application, omitted entirely.

The window shows the address 22 block with a barcode 23 and postage indicia 24 printed on the insert 40. The USPS allows postage included in the address block for outgoing presort mail using a barcode address. No postage is printed or applied to the originating envelope when the postage is in the address block. Having the postage in the address block showing through the window leaves the postage area (upper right corner) 25 on the envelope available for postage when the envelope is mailed a second time. These methods are conventional for reusable envelopes and are approved by the USPS. In an alternative embodiment, a two-way indicia may be printed on the outer envelope in the upper right corner, representing both outbound and return postage, as also disclosed in commonly assigned patent application Ser. No. 14/526,506 incorporated by reference herein above.

On the back panel 51 of the current invention, unlike other reusable envelopes, are a score line 52 and a perforation 50 parallel to each other that extend the length of envelope 10. Score line 52 defines the height of reply envelope 80 after envelope 80 is converted from original envelope 10. The height of reply envelope 80 is measured from the score line to the parallel edge 53 of the envelope. The perforation 50 on the back panel will become the edge of the reply envelope seal flap 61 as described below. The back panel perforation 50 will be used to tear the upper 63 and lower portions 20, 21 of the envelope apart from each other to create smaller reply envelope 80 from original larger envelope 10. The distance between score line 52 and perforation 50 on back panel 51 determines the height of seal flap 61 for resealing envelope 80 when sent as a reply envelope. For exemplary purposes only, and not solely limiting the invention to a particular dimension, if the distance between score line 52 and perforation 50 is ⅝", then seal flap 61 is ⅝" high. Score line 52 will be the fold line for the seal flap 61 of reply envelope 80. Score line 52 is positioned to define the height of a conventional reply envelope for remittance machines. The lower portion 20, 21 of envelope 10 is removed by tearing along back panel perforation 50 and includes the lower portion 20 of the front of the envelope and the lower portion of back 21 of the envelope. In the preferred embodiment, the lower portion 20 of the front of envelope 10 includes security bridge 18 portion on front panel 15 connecting the upper portion 63 and the lower portion 20, 21, and includes a bottom lip 19 of envelope 10 that securely holds the contents 40 in place until intentionally removed by the recipient. The lower portion of the back 21 of the envelope includes original seal flap 30. When the lower portion 20, 21 of the envelope is torn along the back panel perforation 50 it removes the original seal flap 30 on back panel 51.

In accordance with the present invention, front panel 15 has a tab 13 that is used for lifting a strip 14 with parallel-perforated lines 16, 17 that opens the envelope. The perforated opening strip 14 on front panel 15, when removed, removes a section 32 of side seam 12 that is not glued as described above. The section of side seam 12 removed is defined by two lines of perforations 33, 16 in the side seam and is an extension of the perforated opening strip 14 from front panel 15. For purpose of illustration, section 32 of side seam 12 is removed with the perforated opening strip 14 on the right side, but can be located and removed from either the right or the left side. This section 32 is not glued to back pane 51 and has perforations 33 allowing section 32 to be easily removed. The size of section 32 removed is directly related to the size of the second seal flap 61 for sealing reply envelope 80. For example, if the second seal strip is ⅝" wide then the section 32 of the side seam removed is ⅝" wide. Perforated opening strip 14 for opening the envelope can be larger or smaller than the section of the side seam that is removed but in all cases the perforated opening strip 14 and the side seam 32 are considered one piece originating as part of the front panel 15. In addition, removing perforated opening strip 14 on front panel 15 defines the security bridge portion 18 on front panel 15 and a lip 19 along the bottom edge.

Security of personal information is very important to the public. When sending statements companies take extra measures to protect personal information. Often there is a security tint printed on the inside of the envelope for this purpose.

A unique feature of the present invention is the described security bridge portion 18 and bottom lip 19 created when the perforated opening strip 14 for opening the envelope is removed. The bridge portion 18 and the lip 19 each independently of the other and synergistically in combination prevent contents 40 of the envelope from prematurely falling out if the opening is accidentally removed or opened in mail processing or mail delivery. In one alternative embodiment, lip 19 may be eliminated, such as by moving perforation 17 down to the very bottom edge of the envelope. In this embodiment, and if strip 14 is accidentally removed or opened, bridge portion 18 forms a security feature that will still retain the envelope contents therein.

Retaining the contents is very important in modern society, for several different reasons. The first is the inadvertent spilling of sensitive contents and the associated risk of unintentional disclosure of private personal information. Another is the associated risk of jamming machines and delaying mail processing. The security afforded by bridge 18 and lip 19, either independently or synergistically, helps to avoid both of these risks.

For purposes of illustration, bridge 18 will be described on the left side but can be on either the right side, center, or the left, top or bottom. Bottom lip 19 for purposes of illustration will be on the bottom but can be on any side of the envelope. Similarly, opening strip 14 may be provided on either the front panel 15, or the back panel 51.

Bridge section 18 connects to the upper portion 63 of envelope 10 having window 4 and pocket 31 formed by front 15 and back 53 panel and glued side seams 11, 12. The bottom edge of envelope 10 is what remains along the bottom edge when perforated opening strip 14 is removed from front panel 15. Both bridge portion 18 and bottom edge or lip 19 are parts of the lower portion 20 of envelope 10.

As an example, though not limiting the present invention thereto, an extension of perforation 27 at the top of the perforated opening strip 14 extends to the top of bridge section 18 continuing to approximately 1/4" from the edge of the envelope. In this exemplary embodiment, perforation 27 extends to a position adjacent to the edge of the envelope, for exemplary purposes 1/4" from the left edge of the envelope.

Having perforation 27 along the top of bridge 18 terminating adjacent to but some small distance from either the left edge of the envelope or in an alternative embodiment from both edges prevents a weakened edge at that point along the side of the envelope that can possibly cause weakness and tearing in mail processing. The perforation 27 at the top of bridge section 18 extends into side seam 11 becoming the top perforation for the section 35 of side seam 11 that is removed. The bridge portion 18, like perforation opening strip 14, is connected to section 35 of side seam 11 only on the left side, but could be on either side. Like perforated opening strip 14, bridge portion 18 and side seam 35 are considered one piece originating as part of the front panel. Bridge portion 18 also connects the lower portion 20 of the envelope remaining after the perforated opening strip 14 is removed. Perforation 27 at the top of bridge 18 divides the upper portion 63 and lower portions 20, 21 of the envelope. Above perforation 27 is the upper portion 63. Below the perforation 27 including the bridge 18 is part of the lower portion 21 of the back of the envelope. The lower portion 21 of the back of the envelope has the original seal strip 30 attached to it. The lower portion 21 of the back 51 of envelope 10 is defined by a perforation 50 that extends the width of the envelope. Parallel to the perforation on the back panel 50 is a score line 52 also extending the width of the envelope. The perforation 50 and score line 52 form the top edge (perforation) and the fold line (score) for the second seal flap 61 when the envelope has been converted to send as a reply envelope 80. The perforation 50 also functions to separate upper portion 63, including front 15 and back 51, from the lower portion 20 front 15 and back 51 of the envelope to create the smaller reply envelope 80. When the lower portion 20 of the envelope is removed, the perforation 27 at the top of bridge portion 18 is torn, releasing bridge portion 18 from front panel 15 and thereby allowing lower portion 20 to be completely separated from envelope 10.

As illustrated, on back panel 51 is a score line 52 and a perforated line 50 parallel to each other extending across the width of the envelope. After the envelope is open by the perforated opening strip 14 on the front panel 15, the recipient can remove contents 40. When the contents are removed, the score line 52 and perforated line 50 on back panel 51 are visible from the inside of the envelope. Now visible between score line 52 and perforated line 50 on the inside is a glue strip 61 used for resealing the envelope a second time when the smaller reply envelope is returned. Glue strip 61 will remain part of the envelope body when the lower portion of the envelope 21 is removed. Glue strip 61 will function to seal the envelope to send the envelope a second time.

Removing perforated opening strip 14 reveals a portion of the contents 40 of the envelope. In some instances a marketing message 41 could be positioned in the opening that promotes a special offer or delivers an important message to the customer in an impactful manner. When the envelope is opened in the manner described, the inserted contents 40 can be removed by lifting over lip 19 on the bottom edge. Because lip 19 is at the bottom and the inserted material does not slide out, the present invention requires either bridge portion 18 and lip 19 to be removed, or the material to be lifted out over lip 19 at the bottom edge through the opening created by perforated opening strip 14. When the contents are lifted out of the envelope the second seal strip 61 is visible in the back panel 51 as described above.

To manifest the reply envelope the lower portion 20, 21 of the envelope is torn along perforation 50 in back panel 51. Tearing the lower portion 20,21 is accomplished by grasping the corner of the front bottom edge and tearing along the back panel perforation 50. Tearing off the lower portion 20, 21 removes the bridge portion 18 along perforation 27 at the top of the bridge. Removing the bridge portion 18 removes the left section of side seam 35 and completely separates the lower portion 20, 21 from the upper envelope body 63. What remains is the newly formed reply envelope 80 with the second seal strip 61 on the bottom and the upper portion of the original envelope 63. The upper portion 63 has a window 4, a pocket 81 formed by the remaining front panel 15 and back panel 51 and has the right and left side seams 11,12 forming the pocket 81.

Lifting tab 13 and tearing opening strip 14 off, which removes the right side seam section 32, opens the envelope creating the opening to lift the contents from the envelope. The lower portion 20 is released along the perforation on the back panel 51 and along perforation 27 at the top of the bridge portion. When bridge portion 18 is separated it removes the side seam section 35 on the left side. When the lower portion 20, 21 is removed it also removes the original seal flap 30 attached to the lower portion 21 of back panel 51 (when original seal flap 30 is on the bottom, as illustrated in the preferred embodiment envelope 10). The smaller reply envelope 80 is configured when the lower portion 20, 21 of the envelope which includes the bridge portion 18 is completely torn away leaving the upper portion 63 of the envelope, and a second glue line is folded from the back to the front and sealed.

Figure 17:
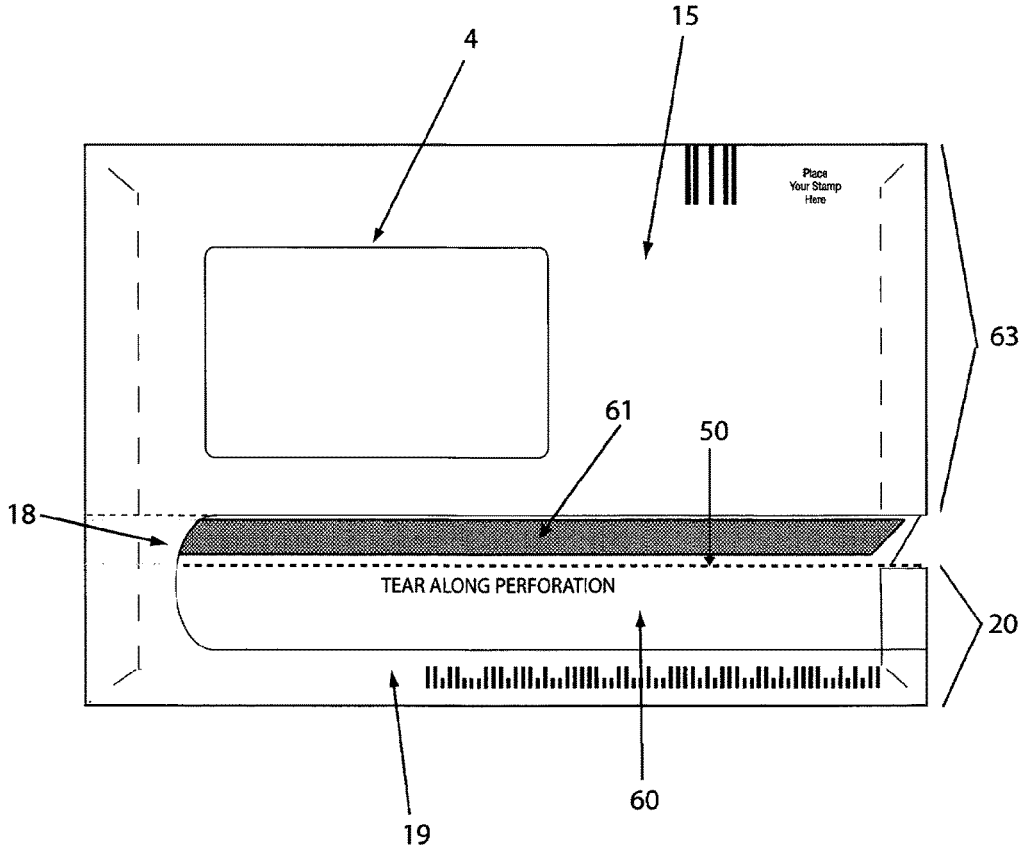
FIG. 17 shows an alternative embodiment to that illustrated in FIG. 12.

In an alternative embodiment, perforation 33 may be eliminated, and instead the entire opening strip 14 may wrap about the envelope. In a further alternative embodiment illustrated in FIG. 17, reply envelope seal flap 61 has a diagonal, tapered, or "V" edge geometry, defined by either a "Z" shaped perforation 33, or by a small triangular notch cut out of the side seam produced at the time of die cutting the blank. In the case of the "Z" perforation, this perforation extends from the front face 15 to the back panel 51 and connects perforation 27 and 33.

When the lower portion 20, 21 of the envelope is removed it removes barcodes 70 the USPS may spray on the envelope to deliver the mail piece. The USPS sprays barcodes 70 to correctly identify the delivery address enabling the mail pieces to be sorted to the correct carrier route for delivering the mail. The USPS sprays the barcodes 70 if the address for some reason is unreadable by postal process equipment. On the front lower right corner the USPS will spray an IMb barcode if the address or the barcode in the address block is not readable by the mail reading and sorting technology. On the back of the envelope a fluorescent ID TAG may also be sprayed on the mail piece routing the piece to the correct location for US delivery. In Canada, a VES barcode may be sprayed. The sprayed IMb barcodes must be obscured or removed from the original mail piece to resend the envelope a second time. The IMb barcode is a priority code;

meaning the mail processing and sorting technology may read this barcode before reading the address block. If the sprayed barcodes remain on the envelope when the envelope is sent as a reply envelope the address has little significance and the mail will be routed to the address described in the sprayed barcode on the envelope. If these barcodes are the original address to the recipient and remain on the envelope when the recipient tries to resend the envelope with a new address, the sprayed barcode will route the mail back to the original address creating a "looping" of the mail. Looping prevents the mail from being delivered to the intended destination, will prevent or cause delays in payments, missed or delayed reply for special offers, and other inconveniences. By removing the lower portion of the described envelope, any POSTNET, ID TAG, VES and IMb barcodes or the equivalent are removed eliminating any opportunity for the mail to loop back to the recipient.

Other unique characteristics are:

- Removal of original contents and return of the remittance portions of the statement or offer of an envelope from the front bottom part of the envelope;
- A reusable envelope in one embodiment having the first seal flap attached to the back panel and the second seal flap attach to the front panel of the envelope;
- Optionally having the first seal flap removed by removing a portion of the envelope;
- A security corner such as created by bridge 18 in the preferred embodiment to prevent contents from falling out in case the opening strip was accidentally opened or torn off;
- Converting a larger envelope to a smaller envelope that facilitates remittance processing;
- A second closing flap with sealing capabilities created by removal of a portion of the original envelope;
- A second glue strip, in the preferred embodiment located in back panel but in alternative embodiments in the front panel, for resealing the envelope for return;
- An opening strip that facilitates removal of portions of the side seam;
- Unique method of removing barcodes, that may be located on either or both of the front and the back with one action to ensure delivery and prevent looping, by removing a section of the envelope;
- Removing the opening strip creates the security mechanism;
- Opening can start at the edge of the envelope or on the face of the envelope, on the front or the back, top or bottom, or either side, but in the preferred embodiment starts offset from the edge to define a bridge structure;
- There can be a tab, finger cut, or any other device to pull, lift, or tear the strip to open the envelope;
- Having the first seal flap seal on the bottom when the mail originates creates may in a preferred embodiment create more effective marketing space on the inside of the envelope, not externally visible;
- An envelope that is designed to convert to a smaller envelope to reduce the amount of paper needed to send mail to a recipient and back, eliminating the need for a separate reply envelope; and
- An envelope that converts from an originating envelope to reply envelope.

Envelopes and a related methods are also described in the Applicant's co-pending Non-Provisional patent application publication No. 2008/0041928, having Ser. No. 11/893,562, entitled Reusable Envelope Structures and Methods, filed on Feb. 24, 2005, the entire disclosure of which is incorporated herein by reference for all purposes.

Reusable envelopes features and methods may be used in accordance with the present invention as are disclosed in the Applicant's co-pending Non-Provisional U.S. Patent Application filed on Jul. 31, 2003 having Ser. No. 10/632,489 and entitled "Environmentally Friendly Reusable Envelope Structures," and Applicant's co-pending Non-Provisional U.S. Patent Application filed on Feb. 24, 2005 having Ser. No. 11/064,791 and entitled "Reusable Envelope Structures and Methods," the disclosure of each are fully incorporated by reference herein for all purposes.

The present invention has now been described with reference to several exemplary embodiments thereof. The entire disclosure of any patent or patent application identified herein is hereby incorporated by reference for all purposes. The foregoing disclosure has been provided for clarity of understanding by those skilled in the art. No unnecessary limitations should be taken from the foregoing disclosure. It will be apparent to those skilled in the art that changes can be made in the exemplary embodiments described herein without departing from the scope of the present invention.

We claim:

1. A reusable reduced-loopback envelope that can be mailed a first time and then converted to a smaller envelope that can be mailed a second time, said reusable reduced loopback envelope comprising:

a front panel having first and third side seams extending from said front panel and defining opposed sides of said front panel;

a back panel separated from said front panel and rigidly adhered to said front panel through said first, and third side seams, and a second side seam between said front panel and said back panel and extending between said first and third side seams, said first, second and third side seams and said front and back panels defining a pocket;

said first and third side seams extending from said front panel and folded with respect to said front panel to thereby define outer distal sides of said pocket;

an address region in at least one of said front and back panels operatively containing at least one of an origin or destination address indicia;

a seal rigidly adhered to a first one of said front and back panels and having an adhesive operative to enclose and seal said pocket;

at least one perforation in each of said front panel and said back panel defining a return envelope border comprising a portion of said front panel less than the entire front panel and a portion of said back panel less than the entire back panel, said front panel perforation extending from a termination adjacent said first seam to a termination adjacent said third seam and said back panel perforation extending from a termination adjacent said first seam to a termination adjacent said third seam;

a return envelope seal strip adjacent one of said front panel and back panel perforations;

a lower envelope region below an address region on said reusable envelope and separated from said address region by one of said front and back panel perforations; and a tear strip adjacent at least one of said front and back panel perforations and said return envelope seal strip and extending incompletely between said first and third seams;

said tear strip when removed operatively defining a bridge between said return envelope and said lower envelope region and when removed further operatively defining a lip distal to said address region and having both front and back panel portions that are operative to retain a document held within said envelope pocket therein while said bridge remains intact;

wherein said bridge is below said address region on said reusable envelope, and operatively separated from said address region by one of said front and back panel perforations and is operatively detached from said return envelope when said front and back panel perforations are severed.

2. The reusable reduced-loopback envelope of claim 1, further comprising a postal code imprinted on said lower envelope region below an address region on said reusable reduced loopback envelope, said lower envelope region including said postal code separated from said address region by one of said front and back panel perforations and operatively detached from said return envelope when said front and back panel perforations are severed.

3. The reusable reduced-loopback envelope of claim 1, further comprising a postage region defining an upper right region of said reusable envelope generally distal to said lower envelope region.

4. The reusable reduced-loopback envelope of claim 1, wherein said front panel perforation first seam termination is offset from said back panel perforation first seam termination and thereby defines a first edge of a return envelope seal flap there between, said front and back panels of said reusable reduced loopback envelope not adhered to each other within said first seam in said return envelope seal flap region; and wherein said front panel perforation third seam termination is offset from said back panel perforation third seam termination and thereby defines a second edge of a return envelope seal flap there between, said front and back panels of said reusable reduced loopback envelope not adhered to each other within said third seam in said return envelope seal flap region.

5. The reusable reduced-loopback envelope of claim 1, wherein at least one of said perforations in each of said front panel and said back panel define a third edge of said return envelope seal flap.

6. The reusable reduced-loopback envelope of claim 1, wherein said seal further comprises a seal flap.

* * * * *